US005564449A

United States Patent [19]

Lin et al.

[11] Patent Number: 5,564,449

[45] Date of Patent: Oct. 15, 1996

[54] ANTI-TWISTING AUTOMATIC UMBRELLA

[75] Inventors: Chung-Kuang Lin; Jung-Jen Chang, both of Taipei Hsien, Taiwan

[73] Assignee: Fu Tai Umbrella Works, Ltd., Taipei Hsien, Taiwan

[21] Appl. No.: 621,459

[22] Filed: Mar. 25, 1996

[51] Int. Cl.[6] ..... A45B 25/14

[52] U.S. Cl. ..... 135/24; 135/25.3; 135/28

[58] Field of Search ..... 135/22–24, 25.1, 135/25.3, 25.33, 25.34, 31, 25.4, 28, 38

[56] References Cited

U.S. PATENT DOCUMENTS

| | | | |
|---|---|---|---|
| 3,625,236 | 12/1971 | Hayano | 135/22 |
| 3,658,076 | 4/1972 | Yasuda | 135/24 X |
| 4,421,133 | 12/1983 | Huang | 135/22 |
| 4,534,374 | 8/1985 | Day | 135/22 |
| 4,682,616 | 7/1987 | Schultes | 135/38 |
| 4,823,821 | 4/1989 | Day | 135/24 |
| 5,144,969 | 9/1992 | Chou et al. | 135/22 |
| 5,144,970 | 9/1992 | Seidel et al. | 135/28 X |
| 5,318,067 | 6/1994 | Day | 135/25.1 X |
| 5,483,985 | 1/1996 | Yu | 135/24 X |

FOREIGN PATENT DOCUMENTS

| | | | |
|---|---|---|---|
| 1516079 | 10/1989 | U.S.S.R. | 135/22 |

*Primary Examiner*—Lanna Mai

[57] ABSTRACT

An automatic umbrella includes: a telescopic central shaft having a lower tube, an intermediate tube, an upper tube and a top tube telescopically engageable with one another; a rib assembly having at least a top rib pivotally secured to a middle runner slidably held on the central shaft, a top linking rib pivotally secured between the top rib and an upper notch fixed on the top tube, and a stretcher rib pivotally secured between the top rib and a lower runner slidably held on the central shaft, the top rib longitudinally formed with an elongate slot in the top rib and the upper, tube having a limiting pin fixed on the upper tube, at least an inner tension spring resiliently retained in the central shaft and urging the limiting pin upwardly, and an outer tension spring resiliently retained between the upper notch and a ring extension formed on the upper tube, whereby upon opening of the umbrella, the limiting pin one the upper tube is linearly guided in the elongate slot in the top tube for preventing twisting of the tubes of the central shaft and the rib assembly for a stable opening of the umbrella.

1 Claim, 4 Drawing Sheets

ANTI-TWISTING AUTOMATIC UMBRELLA

BACKGROUND OF THE INVENTION

A conventional automatic umbrella as shown in FIGS. 4, 5 includes: a central shaft C consisting of plural telescopic tubes operatively extendible for opening the umbrella by an inner tension spring (not shown) held in the central shaft C and an outer tension spring S resiliently held in between an upper notch N fixed on a top end of the central shaft C and a middle runner M slidably held on the central shaft C; and a rib assembly R having a top linking rib R1 pivotally secured to the upper notch N, a top rib R2 pivotally secured to the middle runner M and the top linking rib R1, and a stretcher rib R3 pivotally secured to a lower runner L slidably held on the central shaft C.

Since there is no limiting or guiding mechanism provided for longitudinally guiding the sliding movement of the middle and lower runners M, L on the central shaft C, the rib assembly R as pivotally connected to the upper notch N, the middle and lower runners M, L may be twisted during the opening or closing operations of the umbrella, easily damaging the rib assembly and the umbrella structure.

The present inventor has found the drawbacks of the conventional automatic umbrella and invented the present automatic umbrella having anti-twisting property.

SUMMARY OF THE INVENTION

The object of the present invention is to provide an automatic umbrella including: a telescopic central shaft having a lower tube, an intermediate tube, an upper tube and a top tube telescopically engageable with one another; a rib assembly having at least a top rib pivotally secured to a middle runner slidably held on the central shaft, a top linking rib pivotally secured between the top rib and an upper notch fixed on the top tube, and a stretcher rib pivotally secured between the top rib and a lower runner slidably held on the central shaft, the top rib longitudinally formed with an elongate slot in the top rib and the upper tube having a limiting pin fixed on the upper tube, at least an inner tension spring resiliently retained in the central shaft and upwardly urging the limiting pin, and an outer tension spring resiliently retained between the upper notch and a ring extension formed on the upper tube, whereby upon opening of the umbrella, the limiting pin on the upper tube is linearly guided in the elongate slot in the top tube for preventing twisting of the central shaft and the rib assembly for a stable opening of the umbrella.

DETAILED DESCRIPTION

Figure 1:
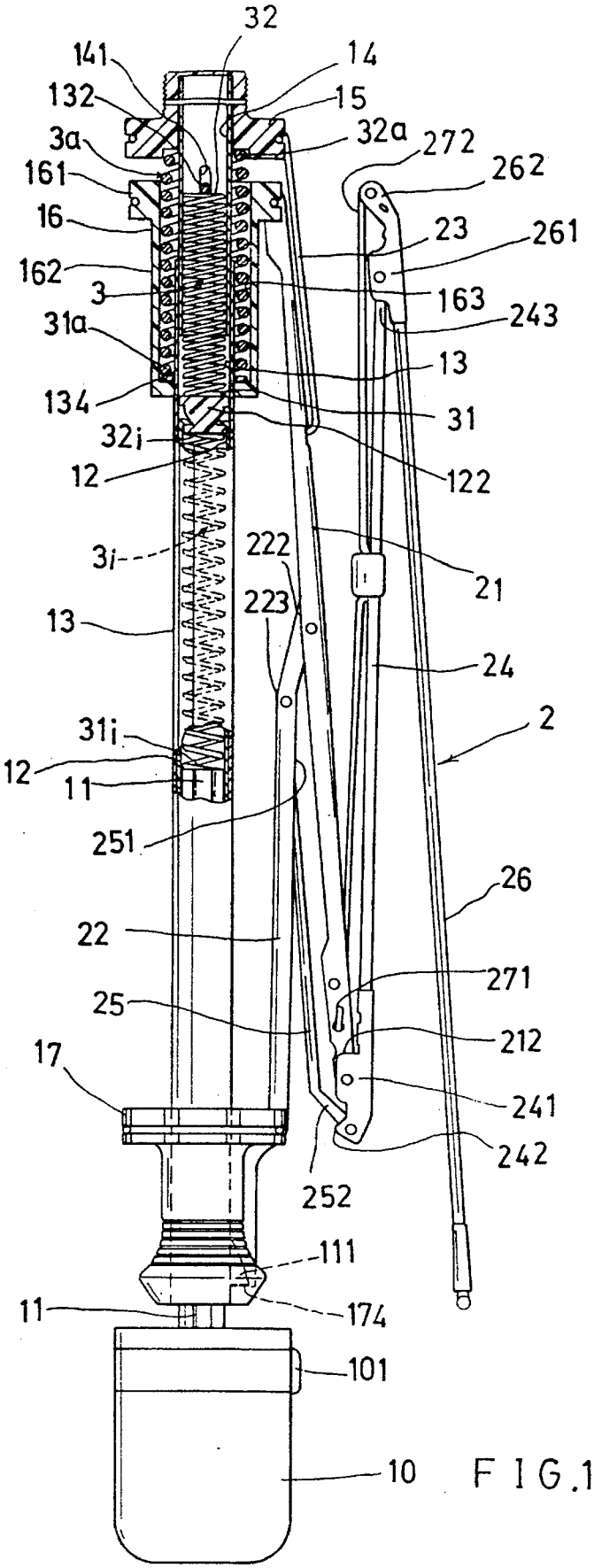
FIG. 1 is a partial sectional drawing of the present invention when folded for storing resilience energy of the related springs.
Figure 2:
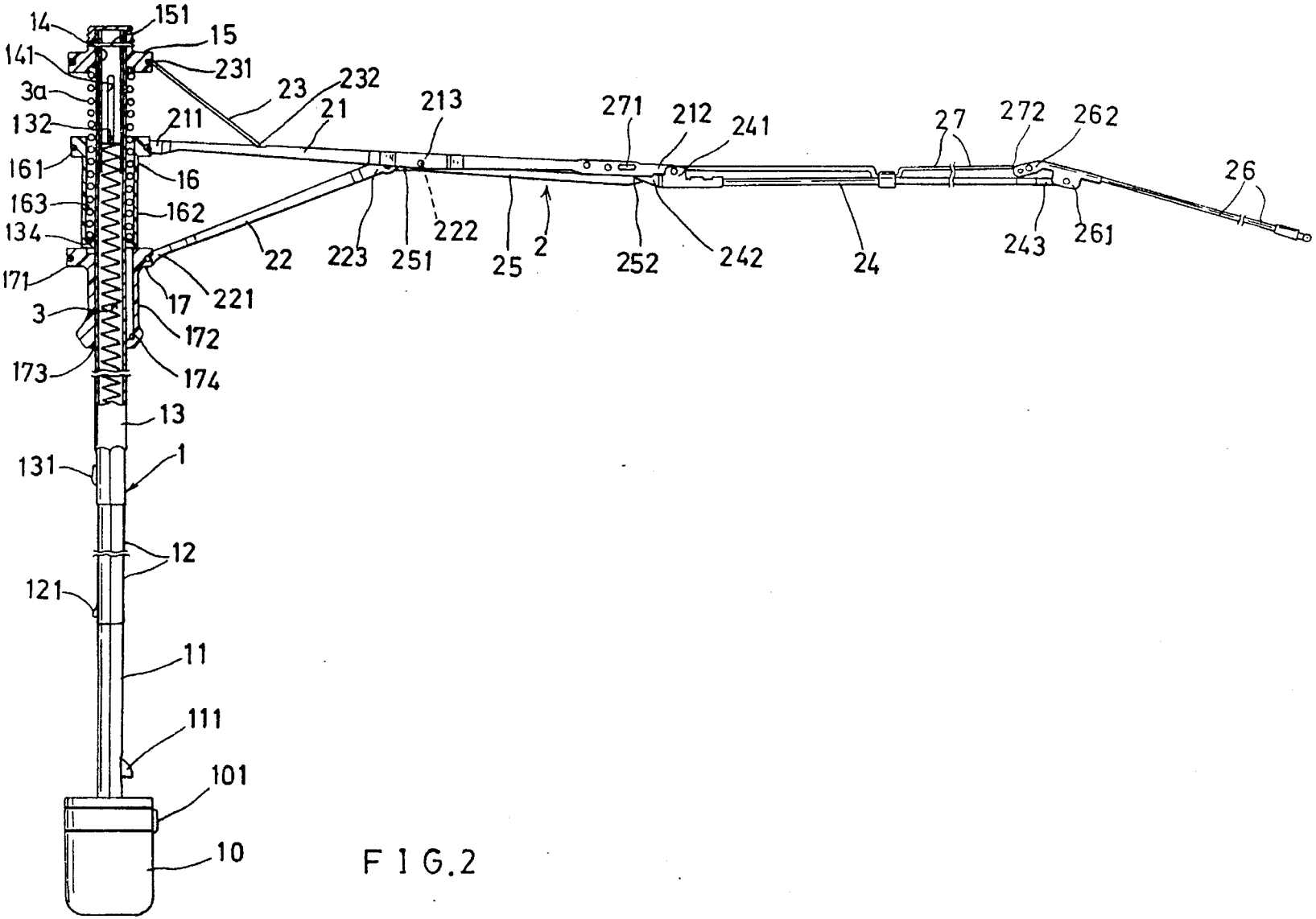
FIG. 2 is an illustration showing an opening umbrella in accordance with the present invention.
Figure 3:
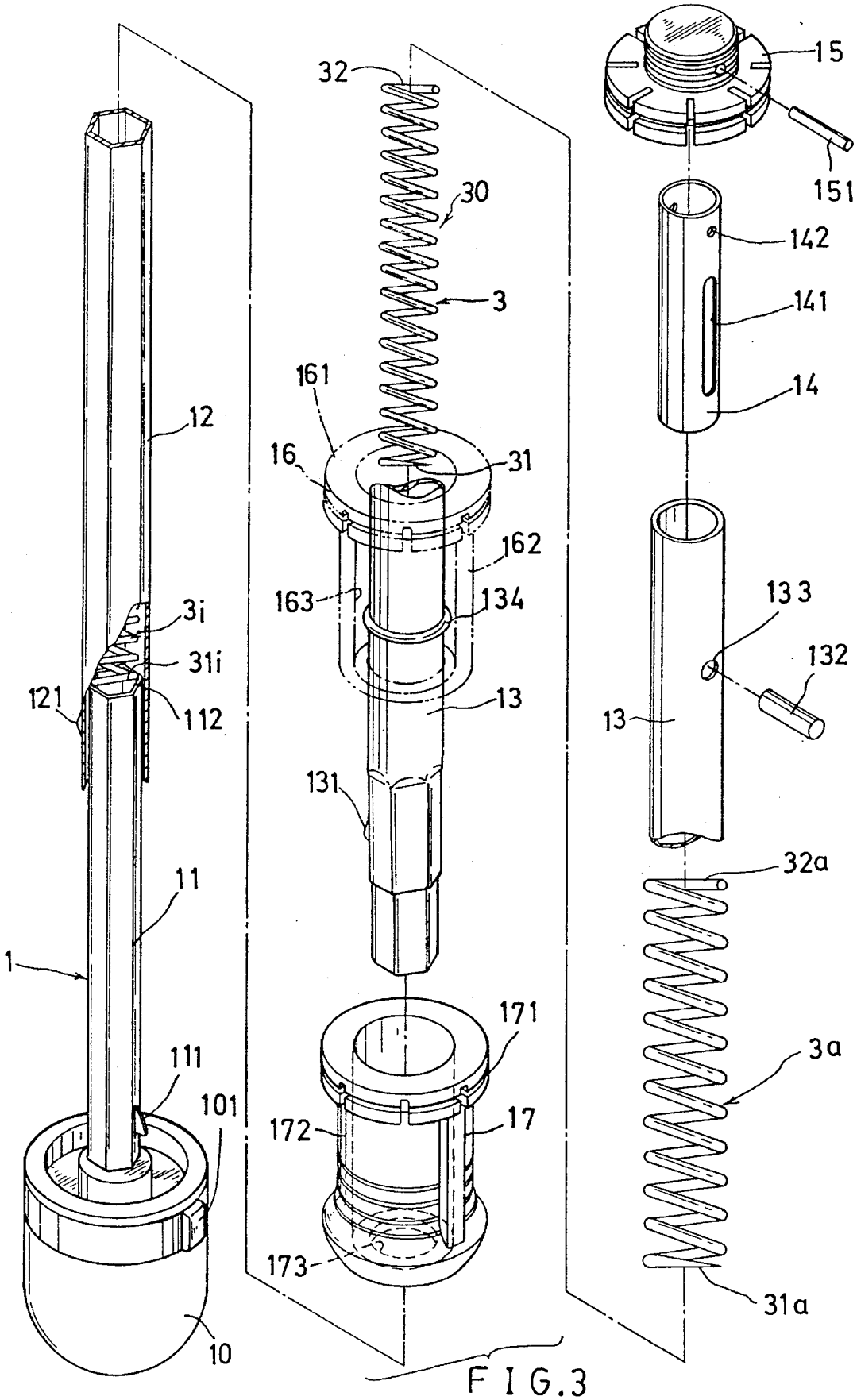
FIG. 3 is an exploded view showing all elements in construction of the present invention.
Figure 4:
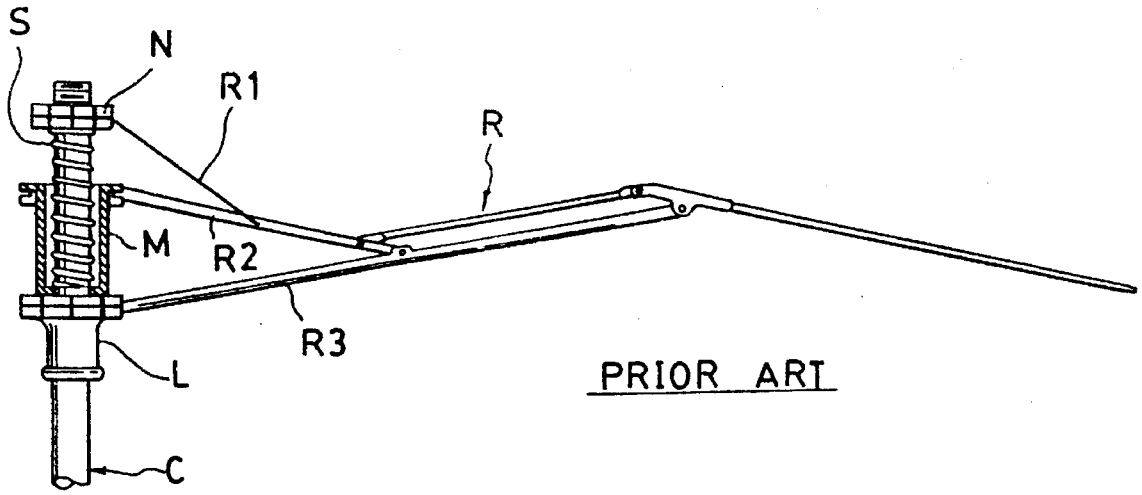
FIG. 4 shows a conventional automatic umbrella when opened.
Figure 5:
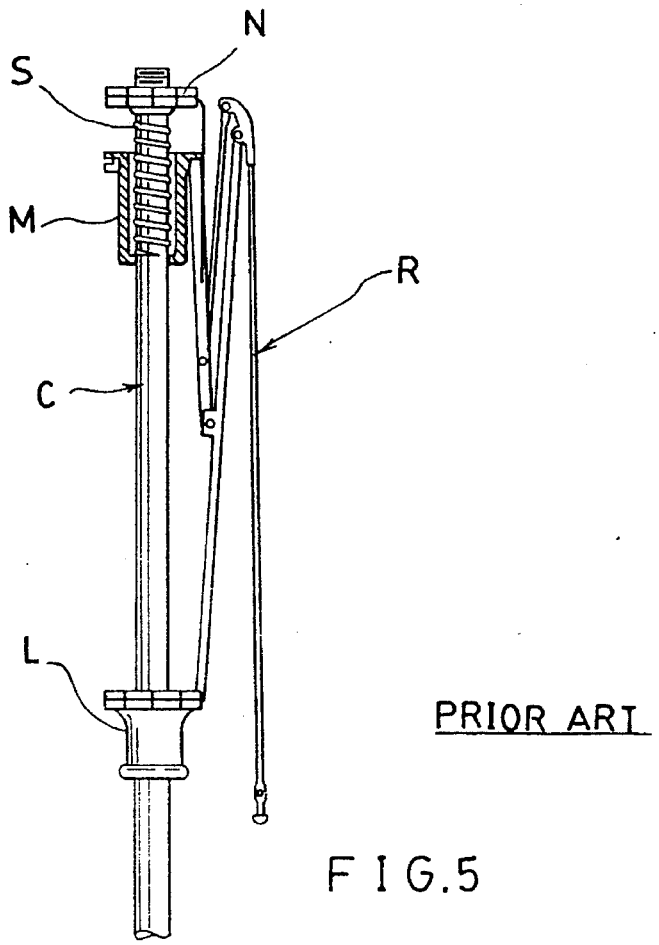
FIG. 5 shows the conventional umbrella when folded.

As shown in FIGS. 1–3, a preferred embodiment of an automatic umbrella in accordance with the present invention comprises: a central shaft 1, a rib assembly 2 pivotally connected to the central shaft 1, an inner tension spring means 30 consisting of an upper inner tension spring 3 and a lower inner tension spring **3*i*, and an outer tension spring 3*a***.

The central shaft 1 includes: a lower inner tube 11 having a grip 10 secured on a lower portion of the lower inner tube 11 with a push button 101 resiliently formed in the grip 10 for opening the umbrella, an intermediate tube 12 slidably engageable with and disposed around the lower inner tube 11, an upper outer tube 13 slidably disposed on an outside of the intermediate tube 12, a top tube 14 slidably held in the upper outer tube 13, an upper notch 15 secured on the upper portion of the top tube 14 by a pin 151 inserted through a pin hole 142 transversely formed through the top tube 14, a middle runner 16 slidably held on the central shaft 1, and a lower runner 17 slidably held on the central shaft 1. All the tubes 11, 12, 13 and 14 are telescopically retractable when closing the umbrella and resiliently extendible when opening the umbrella.

The automatic umbrella of the present invention is made of multiple folds, not limited in this invention. The preferred embodiment of the present invention as shown in the accompanying drawings is triple folds.

The rib assembly 2 includes: a top rib 21 having an inner rib portion 211 pivotally secured to the middle runner 16 and having a rib portion adjacent to the inner rib end 211 pivotally connected with an outer rib portion 232 of a top linking rib 23, the top linking rib 23 having an inner rib portion 231 pivotally secured to the upper notch 15, a stretcher rib 22 having an inner rib portion 221 pivotally secured to the lower runner 17 and having an outermost rib end 222 of the stretcher rib 22 pivotally connected with a middles rib portion 213 of the top rib 21, an intermediate rib 24 having an inner rib portion 241 pivotally connected to an outer rib portion 212 of the top rib 21, an intermediate linking rib 25 having an inner rib portion 251 pivotally connected with an outer rib portion 223 of the stretcher rib 22 and having an outer rib portion 252 of the intermediate rib 25 pivotally connected with an innermost end 242 of the intermediate rib 24, a rear rib 26 having an inner rib portion 261 pivotally connected with an outer rib portion 243 of the intermediate rib 24, and a spring rib 27 generally made as a spring rod having an inner spring end 271 pivotally secured to an outer rib portion of the top rib 21 and having an outer spring end 272 pivotally secured with an innermost end 262 of the rear rib 26.

The inner tension spring means 30 includes: an upper inner tension spring 3 and a lower inner tension spring **3*i* longitudinally held in the central shaft 1. The lower inner tension spring 3*i* has its lower spring end 31*i* rested on a top end 112 of the lower inner tube 11 and an upper spring end 32*i* of the inner tension spring 3 retained against a bottom of plug 122 embedded in a top end portion of the intermediate tube 12**.

The upper inner tension spring 3 has its lower spring end 31 rested upon a plug 122 and an upper spring end 32 of the upper inner tension spring 3 retained against a limiting pin 132 which is inserted into a pin hole 133 transversely formed through the upper outer tube 13. The limiting pin 132 has a length larger than an inside diameter of the upper outer tube 13 and has the length of the pin 132 smaller than an inside diameter of the outer tension spring **3*a*. The upper outer tube 13 is slidably engageable with the top tube 14 by sliding the limiting pin 132 fixed on the upper outer tube 13 within an elongate slot 141 longitudinally cut in the top tube 14 for an upward and downward relative sliding between the top tube 14 and the upper outer tube 13 in a linear movement without being biased and twisted, enhancing a characteristic anti-twisting effect for the present invention since the limiting pin 132 on the upper outer tube 13 is stably guided in the elongate slot 141 in the top tube 14**.

The outer tension spring 3*a* is resiliently held on the top tube 14 and the upper outer tube 13, and also disposed within the middle runner 16. The outer tension spring 3*a* has its lower spring end 31*a* rested upon a ring extension 134 circumferentially formed on the upper outer tube 13 and an upper spring end 32*a* of the outer tension spring 3*a* retained on a bottom of the upper notch 15.

The outer tension spring 3*a* and the inner tension spring means 30 (including the upper spring 3 and the lower spring 3*i*) synergetically form an opening spring for the opening of the automatic umbrella of the present invention.

The inner tension spring means 30 consisting of the upper spring 3 and the lower spring 3*i* will serve for initiating the opening of the umbrella by resiliently extending the central shaft 1 from its folded and retracted state; while the outer tension spring 3*a* serves for opening the umbrella especially for extending the ribs of the rib assembly 2 and the umbrella cloth (not shown) secured only the rib assembly towards an opened state. The outer tension spring 3*a* and the inner tension springs 3, 3*i*, as being previously compressed to store their resilience energy, will quickly extend the tubes of the central shaft 1 and the ribs of the rib assembly 2 to an opened state by releasing the resilience energy of the spring 30, 3*a*, thereby quickly opening the umbrella. The extending and sliding movement of the top tube 14 relative to the upper outer tube 13 will be stably linearly guided by the sliding engagement of the limiting pin 132 on the upper outer tube 13 with the elongate slot 141 formed in the top tube 14. The limiting pin 132 as linearly guided in the elongate slot 141 will prevent a twisting of the tubes 14, 15 of the central shaft 1 and will also prevent the unstable biasing or twisting movement of the ribs of the rib assembly 2, thereby enhancing a stable opening of the umbrella for prolonging the service life of the umbrella to be superior to any conventional automatic umbrella.

The middle runner 16 includes: an upper flange 161 formed on an upper portion of the middle runner 16 for pivotally connecting an inner rib portion 211 of each top rib 21 of the rib assembly 2, a cylindrical handle portion 162 protruding downwardly from the upper flange 161 and slidably held on the central shaft 1, and a socket 163 recessed in the cylindrical handle portion 162 for holding the outer tension spring 3*a* in the socket 163 as shown in FIGS. 1, 2.

The lower runner 17 includes: a flange 171 formed on an upper portion of the lower runner 17 for pivotally connecting an inner rib portion 221 of the stretcher rib 22, a lower cylindrical handle portion 172 protruding downwardly from the flange 171 having a shaft hole 173 formed through the handle portion 172 and the flange 171 for slidably engaging the central shaft 1 to allow an inside wall of the shaft hole 173 for retracting the spring catches 131, 121 of the tubes 13, 12 when retracting the tubes 13, 12, 11 for folding or closing the umbrella, and a shoulder portion 174 formed in a lower portion of the cylindrical handle portion 172 for engaging a hook 111 resiliently formed on a lower portion of the lower inner tube 11 for stably folding their umbrella at its closed state as shown in FIG. 1.

When opening the umbrella of the present invention as shown in the drawing figures from FIG. 1 to FIG. 2, the push button 101 is depressed to disengage the hook 111 to release the inner tension springs 3*i*, 3 to raise and extend the tubes 12, 13 and the outer tension spring 3*a* is actuated to extend the ribs of the rib assembly 2 to pull the top tube 14 upwardly as shown in FIG. 2, and the spring catches 121, 131 are resiliently protruded to stably position the tubes at their extended state for opening the umbrella. Meanwhile, the inner tension springs 3*i*, 3 are linearly retained between the lower tube 11 and the limiting pin 132 of the upper tube 13 for stabilizing the tubes of the central shaft 1 at their extended state, and the outer tension spring 3*a* is stably retained between the ring extension 134 of the upper tube 13 and the upper notch 15 fixed on the top tube 14 for stabilizing the ribs 2 and the umbrella cloth secured on the ribs at their opening situation.

When closing the umbrella, the lower runner 17 is pulled downwardly to retract the rib 2 from FIG. 2 to FIG. 1 to compress the outer and inner springs (3*a*, 3, 3*i*) until the shoulder portion 174 in the lower runner 17 is re-engaged with the hook 111 resiliently held on the lower tube 11 as shown in FIG. 1.

The present invention is superior to the conventional automatic umbrella by the anti-twisting mechanism of the present invention, namely the limiting pin 132 on the upper tube 13 is linearly slidably engageable with and stably guided within the elongate slot 141 longitudinally formed in the top tube 14, for preventing twisting and damage of the umbrella tubes, ribs and the cloth secured on the ribs for a reliable opening and closing operation of the umbrella and for a longer service life of the umbrella.

The present invention may be modified without departing from the spirit and scope as claimed in the present invention.

I claim:

1. An automatic umbrella comprising:

a central shaft including a lower inner tube having a grip formed on a lower portion thereof, an intermediate tube telescopically engageable with and slidably disposed around said lower inner tube, an upper outer tube telescopically engageable with and slidably disposed around said intermediate tube, and a top tube slidably engageable in, said upper outer tube and having an upper notch secured on said top tube;

a rib assembly for securing an umbrella cloth thereon and including at least a top rib pivotally secured to a middle runner slidably held on said central shaft, a stretcher rib pivotally connected between said top rib and a lower runner slidably held on said central shaft, and a top linking rib pivotally connected between the upper notch and the top rib;

at least an inner tension spring resiliently retained in said central shaft and operatively extending the central shaft when opening the umbrella;

an outer tension spring resiliently retained between the upper notch and a portion of said upper outer tube of said central shaft, and operatively extending said rib assembly and the umbrella cloth when opening the umbrella; said inner and outer tension springs compressed for storing resilience energy thereof when closing the umbrella and retracting the rib assembly and the central shaft;

the improvement which comprises:

said top tube longitudinally formed with an elongate slot in said top tube; said upper outer tube having a limiting pin transversely secured in said upper outer tube and linearly slidably engageable with the elongate slot in said top tube for preventing a twisting of said top tube relative to said upper outer tube of the central shaft and for preventing twisting of the rib assembly when opening and closing the umbrella, said outer tension spring resiliently retained between said upper notch and a ring extension circumferentially formed on said upper outer tube, said limiting pin on said upper outer tube resiliently retained on an upper spring end of said inner tension spring, said outer tension spring having a lower spring end rested on said ring extension of said upper outer tube with said ring extension positioned in a socket recessed in said middle runner adjacent to a bottom of said socket in said middle runner, whereby upon opening of the umbrella, the inner tension spring urges the limiting pin of the upper outer tube to raise the upper outer tube to upwardly extend the outer tension spring as retained on the ring extension on the upper outer tube to upwardly push the upper notch, the top tube and the top linking rib to extend the rib assembly for stably opening the umbrella.

* * * * *